US008931394B2

(12) United States Patent
Bryant et al.

(10) Patent No.: US 8,931,394 B2
(45) Date of Patent: Jan. 13, 2015

(54) SYSTEMS AND METHODS FOR PROVIDING FIREARMS WITH LIGHTER COCKING ACTION

(76) Inventors: Martin Bryant, Texas City, TX (US); James M. Buschow, Texas City, TX (US)

( * ) Notice: Subject to any disclaimer, the term of this patent is extended or adjusted under 35 U.S.C. 154(b) by 315 days.

(21) Appl. No.: 13/317,866

(22) Filed: Oct. 31, 2011

(65) Prior Publication Data

US 2012/0048104 A1 Mar. 1, 2012

Related U.S. Application Data

(63) Continuation-in-part of application No. 13/032,815, filed on Feb. 23, 2011, now Pat. No. 8,297,176.

(60) Provisional application No. 61/307,204, filed on Feb. 23, 2010.

(51) Int. Cl.

| | |
|---|---|
| ***F41A 19/37*** | (2006.01) |
| ***F41A 5/02*** | (2006.01) |
| ***F41A 19/50*** | (2006.01) |

(52) U.S. Cl.
CPC . *F41A 5/02* (2013.01); *F41A 19/37* (2013.01); *F41A 19/50* (2013.01)
USPC ..... 89/196; 89/199; 42/1.06; 42/16

(58) Field of Classification Search
USPC ..... 89/196, 199; 42/16, 1.06
See application file for complete search history.

(56) References Cited

U.S. PATENT DOCUMENTS 5,955,696 A * 9/1999 Meller ..... 89/196

* cited by examiner

*Primary Examiner* — Daniel J Troy

(57) ABSTRACT

Apparatuses and methods for facilitating reloading and resisting recoil of a firearm include an elastic member in communication with a portion of the firearm. A contact member coupled to the portion of the firearm, the elastic member, or combinations thereof, is movable between a first position in which movement of the portion of the firearm is biased by the elastic member and a second position in which movement of the portion of the firearm is generally unaffected by the elastic member. An actuator can be used to move the contact member between the first and second positions.

17 Claims, 13 Drawing Sheets

SYSTEMS AND METHODS FOR PROVIDING FIREARMS WITH LIGHTER COCKING ACTION

CROSS-REFERENCE TO RELATED APPLICATIONS

This nonprovisional patent application is a continuation-in-part of and claims priority under 35 U.S.C. §120 to the co-pending U.S. patent application having the Ser. No. 13/032,815, filed Feb. 23, 2011, which claims priority to the U.S. Provisional Application having the Ser. No. 61/307,204, filed Feb. 23, 2010, each of which are incorporated by reference herein, in their entirety.

FIELD

Embodiments usable within the scope of the present disclosure relate, generally, to firearms, and systems and methods for providing firearms with a lighter cocking action (e.g., less resistance when manually chambering and/or reloading a firearm), and more specifically to systems for selectively controlling whether a recoil spring of a firearm will be compressed, enabling the resistance of the recoil spring to be removed when manually chambering the firearm, and applied to reduce recoil forces when the firearm is discharged.

BACKGROUND

Most semi-automatic pistols include a slide biased toward a forward position on the frame. When the firearm is discharged, the slide is moved in a rearward direction by the recoil from the fired cartridge. Typically, a recoil spring coupled to the slide is compressed as the slide moves rearwardly, which serves the dual purpose of reducing the recoil force felt by the user when discharging the firearm, and biasing the slide back to its original position after the slide clears the magazine such that another cartridge from the magazine is reloaded into the chamber. Thus, after each discharge of a cartridge, the firearm uses the recoil force produced by the discharge to cock and reload the firearm, and a recoil spring to reduce the portion of the recoil force felt by the user and return the slide to its original position.

To initially load a semi-automatic pistol or similar firearm, a magazine is typically inserted into the butt of the firearm. The slide must then be manually pulled backward by the user to load the first cartridge from the magazine into the firing chamber. Manual movement of the slide in this manner is resisted by the recoil spring and requires a substantial force, typically in excess of five to ten pounds, which can prevent individuals lacking in strength from reloading a firearm comfortably and quickly. Additionally, the large manual force required to load a firearm limits the strength of the recoil spring that can be used; while a stronger recoil spring could significantly reduce the recoil force felt by a user discharging the firearm, use of a stronger spring would proportionally increase the force required to manually move the slide to initially load the firearm.

A need exists for systems and methods usable to provide firearms with an easier (e.g., lighter) cocking action to reduce the force required to load an initial round from a magazine into the firing chamber, such as by selectively enabling force from the recoil spring to be disengaged from the slide, while permitting the recoil spring to function normally during discharge of the firearm and subsequent loading of rounds from the magazine.

Embodiments usable within the scope of the present disclosure meet these needs.

SUMMARY

Embodiments usable within the scope of the present disclosure relate to apparatus and methods for facilitating reloading and resisting recoil of firearms. While the embodiments disclosed herein are depicted and described for use with semiautomatic pistols, it should be understood that various embodiments of the apparatus and methods described herein can be used with any type of firearm.

Generally, an embodied apparatus for facilitating reloading and resisting recoil of a firearm can include an elastic member (e.g., a spring) in communication with a portion of a firearm (e.g., a slide or similar moveable portion). A contact member coupled to the portion of the firearm and/or the elastic member can be moved between a first position and a second position. When the contact member is in the first position, movement of the portion of the firearm is biased by the elastic member, and when the contact member is in the second position, movement of the portion of the firearm is generally unaffected by the elastic member. An actuator can be used to move the contact member between the first position and the second position. In an embodiment, the contact member can be biased toward either the first or second position using one or more springs or similar biasing members, while the actuator is used to cause movement of the contact member against the biasing members.

As such, a semiautomatic pistol or similar firearm can be provided with a recoil spring or similar elastic member, and engagement between the recoil spring and the slide or a similar movable portion of the firearm can be selectively controlled through actuation of the contact member. Thus, when the contact member is in the first position, the recoil spring biases movement of the slide to resist the recoil force imparted to the firearm when discharged. When the contact member is in the second position, the recoil spring is effectively disengaged from the slide, such that the slide can be manually pulled to load the firearm without requiring the manual force to overcome the bias of the recoil spring. This provides the dual benefit of facilitating loading of the firearm, uninhibited by the recoil spring, while enabling the firearm to be provided with a stronger recoil spring that can resist a greater portion of recoil forces than conventional springs.

In an embodiment, the portion of the firearm engageable with the elastic member can include a chamber slide having at least one moveable member that couples the chamber slide directly or indirectly to the recoil spring or similar elastic member. For example, roller pegs or similar movable members can be used to engage the chamber slide with a recoil slide that is coupled to a recoil spring. The roller pegs or similar moveable members can be moved from a first position, in which the chamber slide is coupled to the elastic member, to a second position, in which the chamber slide is freely movable relative to the elastic member.

The firearm can include a grip slide or similar movable element of the firearm, configured such that movement of the grip slide in a first direction relative to the portion of the firearm engageable with the elastic member causes movement of the contact member toward the second position, and movement of the grip slide in a second direction causes movement of the contact member toward the first position, such that engagement between the elastic member and the movable portion of the firearm can be controlled through manipulation of the grip slide.

The grip slide, chamber slide, and/or any other movable portion of the firearm can include additional springs or similar elastic members, usable to bias movement of these portions of the firearm independent of the position of the contact member and use of the recoil spring.

For example, in an embodiment, a firearm having a chamber slide and a recoil slide can include roller pins or similar movable members that couple the chamber slide to the recoil slide. When discharged, the recoil slide is urged backward, compressing the recoil spring of the firearm. However, when a grip slide is manually pulled backward the roller pins are permitted to move, disengaging the chamber slide from the recoil slide. Thus, continued manual movement of the chamber slide, unaffected by the recoil spring, is possible when reloading the firearm.

In other embodiments, the contact member of the firearm can include an orifice coupled with one or more movable members movable to at least partially cover the orifice, such that when the orifice is uncovered, the elastic member can pass through the orifice without imparting a force to the firearm, while when the orifice is covered, the elastic member contacts the one or more movable members and imparts a force thereto, thus resisting movement of a portion of the firearm.

For example, the contact member can include one or more hinged and/or pivotable doors movable to open and close the orifice. When closed, the doors block passage of the recoil spring or similar elastic member, while when open, the doors permit passage of the recoil spring such that the slide or similar movable portion of the firearm can be manipulated without the recoil spring imparting a force thereto. Alternatively and/or additionally, the contact member can include one or more sliding doors, movable into and from a position that at least partially overlaps the orifice. When overlapping the orifice, the sliding door prevents passage of the recoil spring or similar elastic member therethrough. When the orifice is uncovered, the recoil spring can pass through such that movement of the slide or similar movable portion of the firearm is generally unaffected by the recoil spring. Other embodiments can include an "iris" member, in which one or more cams and/or similar diameter-reducing members can be moved and/or extended toward the center of the orifice to reduce the diameter thereof. When the orifice is provided with a reduced diameter, the iris prevents passage of the recoil spring or similar elastic member therethrough. When the orifice is not covered by the iris member, the recoil spring can pass through such that movement of the slide or similar movable portion of the firearm is generally unaffected by the recoil spring.

In various embodiments, the actuator can include a blocking member movable between a first position, in which movement of the contact member is blocked, and a second position, in which movement of the contact member is permitted. Thus, for example, the blocking member can be used to prevent opening of the hinged doors or similar pivotable members when the firearm is discharged, such that the elastic member is compressed by the pivotable members and resists the associated recoil force; however, when the slide or similar movable portion of the firearm is manually pulled, this movement can concurrently move the blocking member, allowing the hinged doors or similar pivotable members to open to prevent contact with the elastic member.

In other embodiments, the actuator can include a coupling between the trigger of the firearm and the contact member, such that movement of the trigger moves the contact member between the first and second position. For example, as the trigger of the firearm is pulled to discharge the firearm, one or more movable members can be caused to at least partially cover an orifice, as described previously, such that the recoil spring or a similar elastic member imparts a force to the firearm to resist the recoil force. However, manual movement of the slide or similar movable portion of the firearm, that does not require movement of the trigger, would not actuate the contact member, thus manual movement of the slide would be unimpeded by the recoil spring.

In further embodiments, the actuator can include one or more pistons, or similar elongate members, usable to cause movement of the contact member between the first and second positions. The one or more pistons can be in communication with a fluid source, which can include tubes and/or similar conduits coupled to the barrel of the firearm for transporting gas produced by discharging the firearm to the pistons, causing movement thereof. For example, upon discharge of the firearm, gas produced by the discharge can be transported through tubes or similar conduits to actuate the contact member moments before the recoil force moves the slide or other movable portion of the firearm, such that the recoil spring resists the recoil force.

As such, embodiments usable within the scope of the present disclosure relate to apparatus and methods usable to selectively control whether a recoil spring or similar elongate member applies a force to a slide or similar moveable portion of a firearm.

BRIEF DESCRIPTION OF THE DRAWINGS

In the detailed description of various embodiments of the present invention presented below, reference is made to the accompanying drawings, in which.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Referring now to FIGS. 1A through 1L, a firearm (10) is shown, having an embodiment of an apparatus usable within the scope of the present disclosure installed therein to facilitate manual reloading and reduce recoil forces felt by a user. Specifically, FIGS. 1A through 1D depict the firearm (10) in a battery position (e.g., ready to discharge and/or unloaded or otherwise at rest). All portions of the firearm (10) depicted in FIGS. 1A through 1D are thereby shown in a position in which the firearm (10) is not subject to any recoil forces, any manual force imparted by a user, or any internal forces from springs or similar elastic and/or biasing members sufficient to cause movement. FIGS. 1E through 1H depict the firearm (10) during manual reloading thereof, which can be performed by manually manipulating a portion of the firearm (10), which is disengaged from the recoil spring through application of a manual force thereto. Internal springs or similar members, other than the recoil spring, can bias the movable portion of the firearm (10) toward the battery position during reloading. FIGS. 1I through 1L depict the firearm immediately following discharge thereof (e.g., when subjected to a recoil force). Movable portions of the firearm (10) are shown compressing, and therefore being affected by the recoil spring of the firearm (10), the recoil spring biasing the movable portions of the firearm (10) toward the battery position.

Figure 1A:
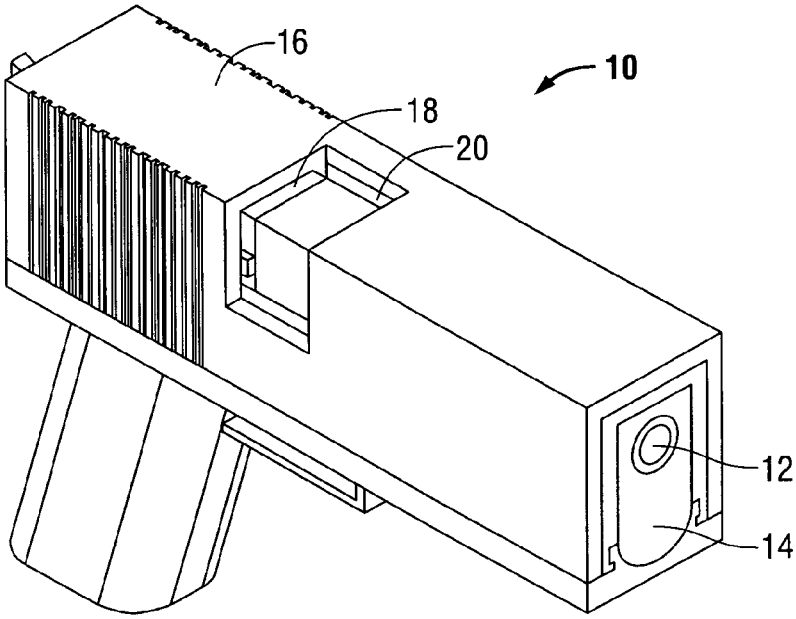
FIG. 1A depicts an isometric view of a firearm in battery (e.g., ready to discharge ammunition when actuated) that includes an embodiment of an apparatus usable within the scope of the present disclosure.

FIG. 1A shows an isometric view of the firearm (10), in the battery position, described above. It should be understood that while FIG. 1A and the subsequent figures depict the firearm (10) as a semiautomatic pistol, embodiments usable within the scope of the present disclosure can be used with any type of firearm. Specifically, the firearm (10) is shown as a pistol having a barrel (12) with an opening disposed in the front face (14) thereof, and a handle, trigger and trigger guard, hammer, body, and firing chamber, as known in the art.

The depicted firearm (10) includes three movable portions usable to selectively couple and uncouple an internal recoil spring therefrom. Specifically, the firearm (10) is shown having a grip slide (16) disposed on the exterior surface thereof, the grip slide (16) being manually moveable by a user, e.g., by pulling the grip slide (16) in a rearward direction relative to the front face (14). A chamber slide (18) is shown internal to the grip slide (16), the chamber slide (18) being similarly moveable, e.g., in a rearward direction, through application of a manual force. A recoil slide (20) is also shown internal of the grip slide (16) and can be moved in a rearward direction through application of a recoil force during typical operation. Application of a manual force to the grip slide (16) can uncouple the associated chamber slide (18) from the recoil slide (20), as described below, such that the manual force does not move the recoil slide (20) and is not affected by the recoil spring of the firearm (10). However, during application of a recoil force, the grip slide (16) and chamber slide (18) can also be moved in a rearward direction relative to the body of the firearm (10) as the recoil slide (20) is moved, due to coupling between the chamber slide (18) and the recoil slide (20).

Figure 1B:
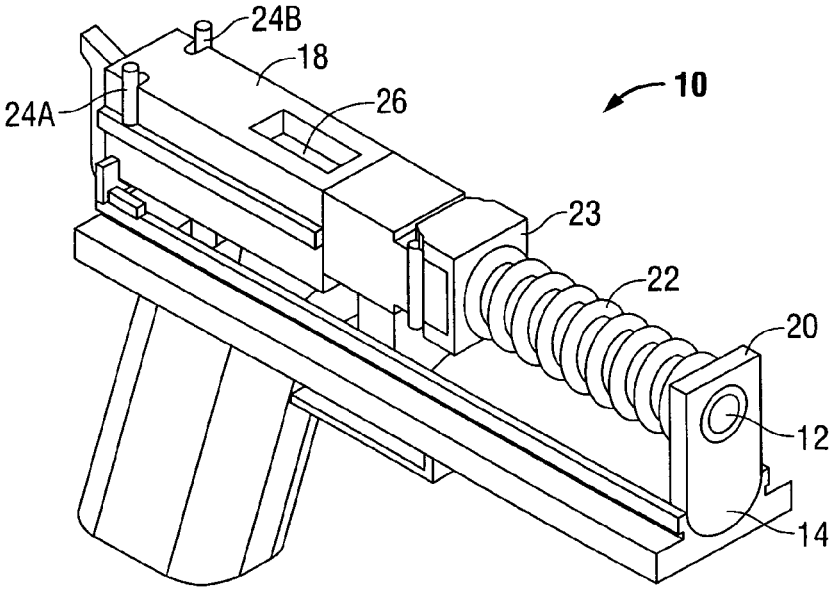
FIG. 1B depicts an isometric view of the firearm of FIG. 1A, having exterior portions removed to depict interior components thereof.

Referring now to FIG. 1B an isometric view of the firearm (10) of FIG. 1A is shown, having the grip slide (16, shown in FIG. 1A) and portions of the recoil slide (20) that extend along the sides of the firearm (10) removed from view such that internal components of the firearm (10) can be visualized. A recoil spring (22) is shown disposed around the barrel (12), such that when the firearm (10) is discharged, the front face (14) and/or the front portion of the recoil slide (20) will be urged backward against the recoil spring (22), which will apply an opposing force to the front face (14) and/or the recoil slide (20) to reduce the recoil felt by a user gripping the firearm (10) and return the front face (14) and/or the recoil slide (20) to the battery position. A plate (23) or similar structure can serve as a stop against which the recoil spring (22) can be compressed, though in various embodiments, the recoil spring (22) could be securely connected to the barrel (12) itself or another portion of the firearm (10) to enable compression thereof.

Two roller pins (24A, 24B) are shown engaged within corresponding notches in the chamber slide (18). The roller pins (24A, 24B) can also engage corresponding notches within side portions of the recoil slide (20—the side portions of the recoil slide are omitted from FIG. 1B for clarity), such that the chamber slide (18) and the recoil slide (20) are coupled together and move in unison. Thus, a recoil force produced by discharging the firearm (10) would move both the recoil slide (20) and the chamber slide (18) in a rearward direction (and the grip slide as well, through contact with the chamber slide (18)), while the recoil spring (22) would exert a counter force to resist this movement and return the recoil slide (20) and chamber slide (18) to the battery position. The chamber slide (18) is also shown having an opening (26) in an upper surface thereof, through which a tab in the grip slide (16, shown in FIG. 1A) can pass to engage a grip spring therein. The length of the opening (26) can limit the independent movement of the grip slide relative to the chamber slide (18), e.g., contact between a tab or similar protrusion of the grip slide and the ends of the opening (26) can cause continued movement of the grip slide to cause concurrent movement of the chamber slide (18).

Figure 1C:
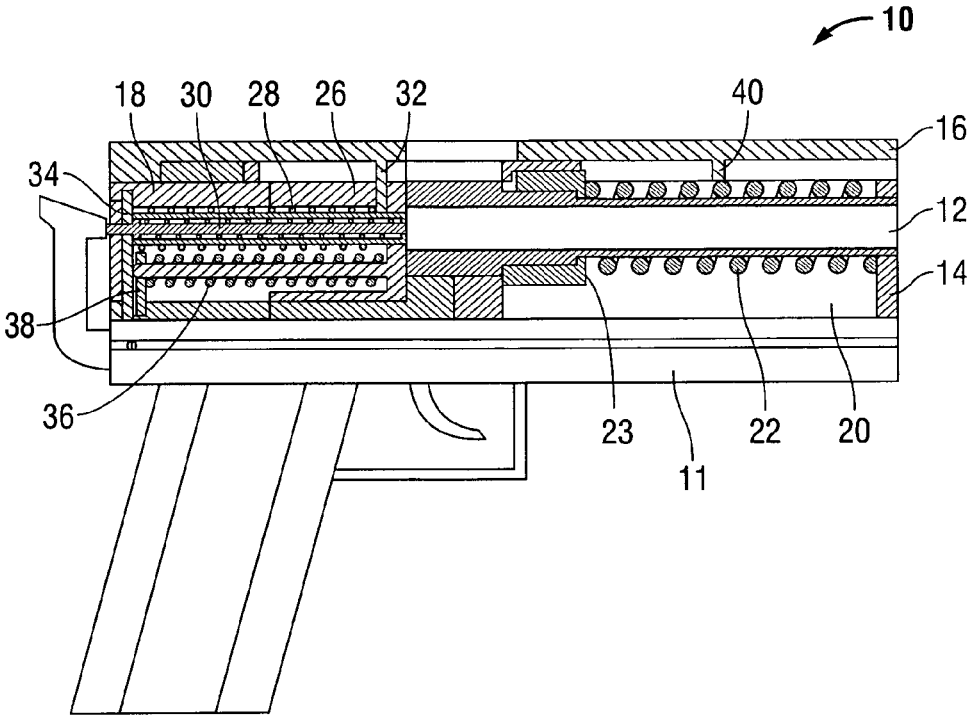
FIG. 1C depicts a side cross-sectional view of the firearm of FIG. 1A.

Referring now to FIG. 1C, a side cross-sectional view of the firearm (10) of FIG. 1A is shown. As described previously, the firearm (10) includes three portions movable relative to the body (11) thereof: the grip slide (16), the chamber slide (18), and the recoil slide (20). Movement of the recoil slide (20) is resisted and/or biased by the recoil spring (22), while movement of the grip slide (16) and/or the chamber slide (18) is affected by the recoil spring (22) only when the roller pins (24A, 24B, shown in FIG. 1B) are in a position that couples the chamber slide (18) to the recoil slide (20). Manual movement of the grip slide (16) and/or the chamber slide (18) independent of the recoil slide (20) (e.g., by uncoupling the chamber slide (18) from the recoil slide (20)) can remain unaffected by the recoil spring (22), thus facilitating manual reloading of the firearm (10).

Movement of the grip slide (16) can be biased by a grip slide spring (28), disposed around the firing pin (30) of the firearm. As the grip slide (16) is moved in a rearward direction relative to the body (11) of the firearm (10), the tab (32) of the grip slide (16), which extends through the opening (26) in the chamber slide (18), engages and compresses the grip slide spring (28) against a stop (34), such that the grip slide spring (28) biases the grip slide (16) toward the battery position. Similarly, movement of the chamber slide (18) can be biased by an internal chamber slide spring (36), which is compressed against a stop (38) as the chamber slide (18) is moved in a rearward direction. Movement of the grip slide (16) relative to the chamber slide (18) can be limited by the length of the opening (26), as described previously. Movement of the grip slide (16) relative to the recoil slide (20) can be limited through contact between a grip slide stop (40) and the plate (23).

Figure 1D:
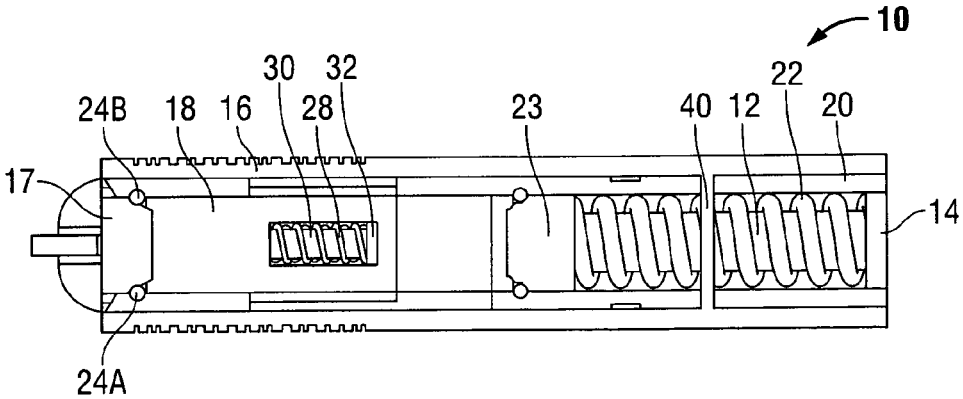
FIG. 1D depicts a top cross-sectional view of the firearm of FIG. 1A.

Referring now to FIG. 1D, a top cross-sectional view of the firearm (10) of FIG. 1A is shown having the grip slide (16), chamber slide (18), and recoil slide (20) movable relative to the body of the firearm (10), as described previously. The roller pins (24A, 24B) are shown engaged within corresponding notches of both the chamber slide (18) and the recoil slide (20) such that the chamber slide (18) and recoil slide (20) are coupled together, able to move in unison. As such, when the firearm (10) is discharged, the recoil slide (20) is urged in a rearward direction. The chamber slide (18) and/or grip slide (16) are also urged in the rearward direction by the recoil force due to the connection between the chamber slide (18) and the recoil slide (20) via the roller pins (24A, 24B). The recoil spring (22) provides a counter force to reduce the recoil force felt by a user, and returns the slides (16, 18, 20) to their original positions prior to the discharge of the firearm (10).

When it is desired to disengage the chamber slide (18) from the recoil slide (20), e.g., to enable manual movement of the chamber slide (18) and/or the grip slide (16), unaffected by the recoil spring (22) for reloading the firearm (10), the grip slide (16) can be manually pulled in a rearward direction. As shown in FIG. 1D, the grip slide (16) includes a rear portion (17) that retains the roller pins (24A, 24B) in the depicted position that couples the chamber slide (18) to the recoil slide (20). Rearward movement of the grip slide (16) causes the rear portion (17) to move away from the chamber slide (18), allowing the roller pins (24A, 24B) to slide inward such that the chamber slide (18) is no longer engaged with the recoil slide (20). Continued rearward movement of the grip slide (16) after disengagement of the roller pins (24A, 24B) can cause rearward movement of the chamber slide (18), unimpeded by the recoil spring (22) due to the fact that the manual force imparted to the chamber slide (18) is not imparted to the recoil slide (20). Thus, the depicted configuration can enable the firearm (10) to be manually reloaded without requiring the force provided by the recoil spring (22) to be overcome.

Figure 1E:
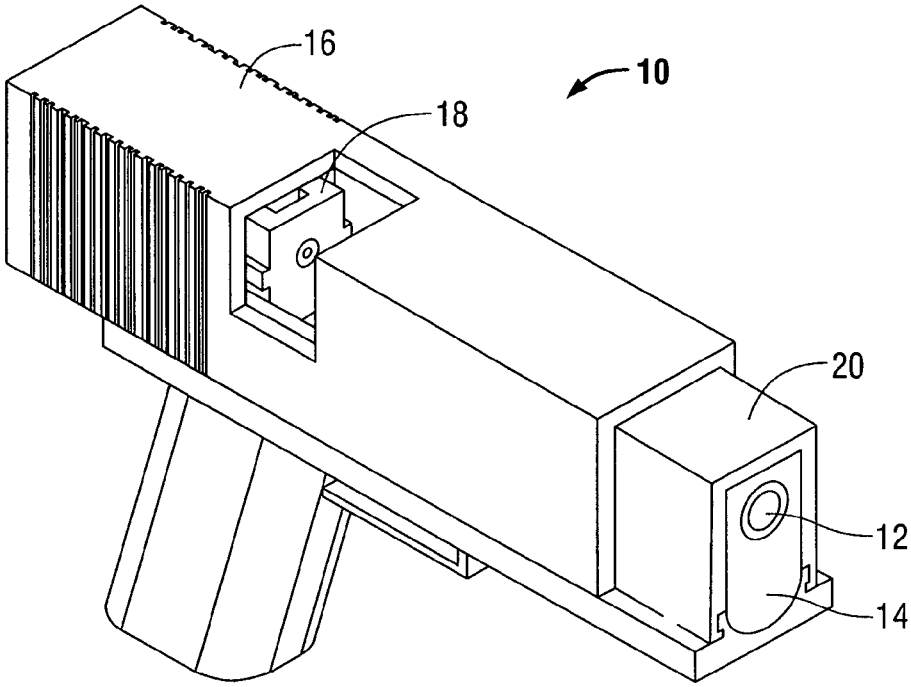
FIG. 1E depicts an isometric view of the firearm of FIG. 1A positioned for manual chambering (e.g., reloading) thereof.

For example, FIG. 1E depicts an isometric view of the firearm (10) of FIG. 1A positioned for manual chambering (e.g., reloading) thereof. As described previously, the firearm (10) includes a grip slide (16), a chamber slide (18), and a recoil slide (20), each moveable relative to the body of the firearm (10), e.g., in a rearward direction when affected by a manual force and/or a recoil force. FIG. 1E depicts the firearm (10) having the chamber slide (18) disengaged from the recoil slide (20), e.g., through manual movement of the grip slide (16) to permit uncoupling of the chamber and recoil slides (18, 20) via the roller pins (24A, 24B, shown in FIG. 1D). As shown, the grip slide (16) and the chamber slide (18) have been moved in a rearward direction (e.g., through application of a manual force), while the recoil slide (20) remains in the original (e.g., battery) position, shown in FIG. 1A.

Figure 1F:
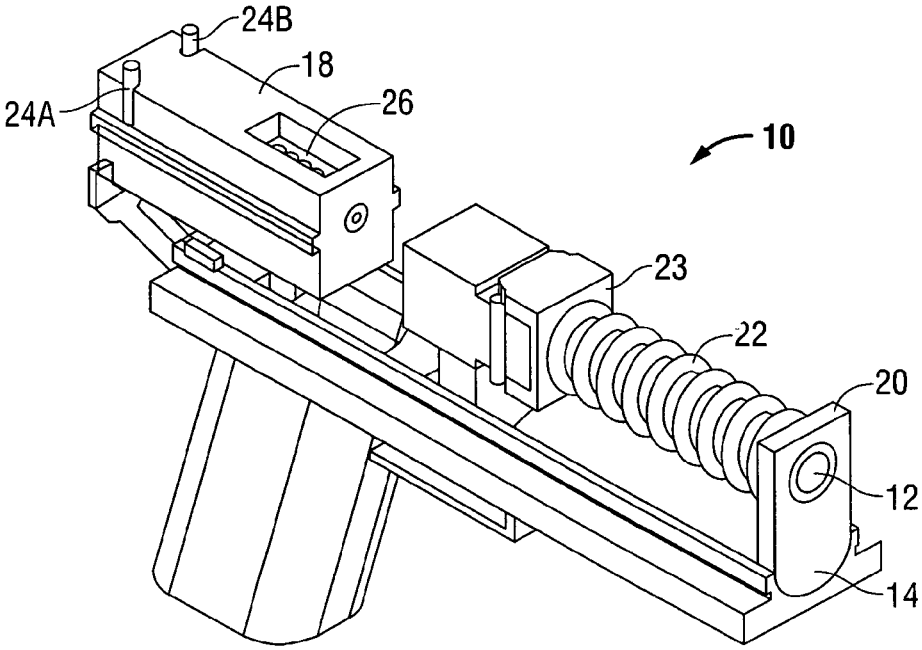
FIG. 1F depicts an isometric view of the firearm of FIG. 1E, having exterior portions removed to depict interior components thereof.

FIG. 1F depicts an isometric view of the firearm (10) of FIG. 1E, having the grip slide (16, shown in FIG. 1E) and portions of the recoil slide (20) that extend along the sides of the firearm (10) removed from view such that internal components of the firearm (10) can be visualized. As described above, the grip slide (16, shown in FIG. 1E) and chamber slide (18) are shown positioned in a rearward direction from that shown in FIG. 1B (e.g., following application of a manual force to the grip slide (16)), while the recoil slide (20) and associated recoil spring (22) remain in the battery position, shown in FIG. 1B. The roller pins (24A, 24B) are depicted recessed into corresponding notches of the chamber slide (18), such that the chamber slide (18) is disengaged from the recoil slide (20) and is able to move freely relative thereto. As depicted, movement of the grip slide (16) and/or the chamber slide (18) in the manner shown is generally unaffected by the recoil spring (22) due to the disconnection of the chamber slide (18) from the recoil slide (20).

Figure 1G:
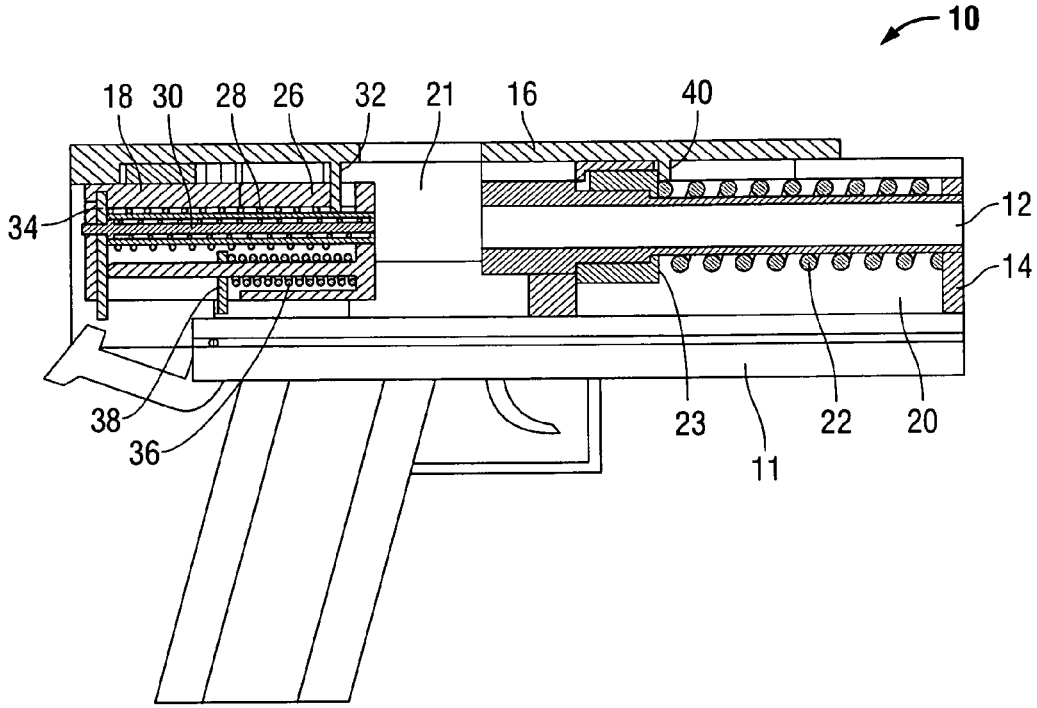
FIG. 1G depicts a side cross-sectional view of the firearm of FIG. 1A.

Referring now to FIG. 1G, a side cross-sectional view of the firearm (10) of FIG. 1E is shown. As described previously, the firearm (10) includes three portions movable relative to the body (11) thereof: the grip slide (16), the chamber slide (18), and the recoil slide (20). Movement of the recoil slide (20) is resisted and/or biased by the recoil spring (22), while movement of the grip slide (16) and/or the chamber slide (18) is affected by the recoil spring (22) only when the roller pins (24A, 24B, shown in FIG. 1F) are in a position that couples the chamber slide (18) to the recoil slide (20). Manual movement of the grip slide (16) and/or the chamber slide (18) independent of the recoil slide (20) (e.g., by uncoupling the chamber slide (18) from the recoil slide (20)) can remain unaffected by the recoil spring (22). FIG. 1G depicts the chamber slide (18) disconnected from the recoil slide (20), and moved in a rearward direction relative to the recoil slide (20), defining a space (21) between the chamber slide (18) and recoil slide (20).

FIG. 1G shows rearward movement of the grip slide (16) biased by the grip slide spring (28), disposed around the firing pin (30). As the grip slide (16) is moved in a rearward direction relative to the body (11), the tab (32), which extends through the opening (26) in the chamber slide (18), engages and compresses the grip slide spring (28) against a stop (34), which causes the grip slide spring (28) to bias the grip slide (16) toward its original (e.g., battery) position (shown in FIG. 1C). Similarly, movement of the chamber slide (18) is biased by an internal chamber slide spring (36), which is compressed against a stop (38) as the chamber slide (18) is moved in a rearward direction. Movement of the grip slide (16) relative to the chamber slide (18) can be limited by the length of the opening (26), as described previously. Additionally, movement of the grip slide (16) relative to the recoil slide (20) can be limited through contact between the grip slide stop (40) and the plate (23), as depicted.

Figure 1H:
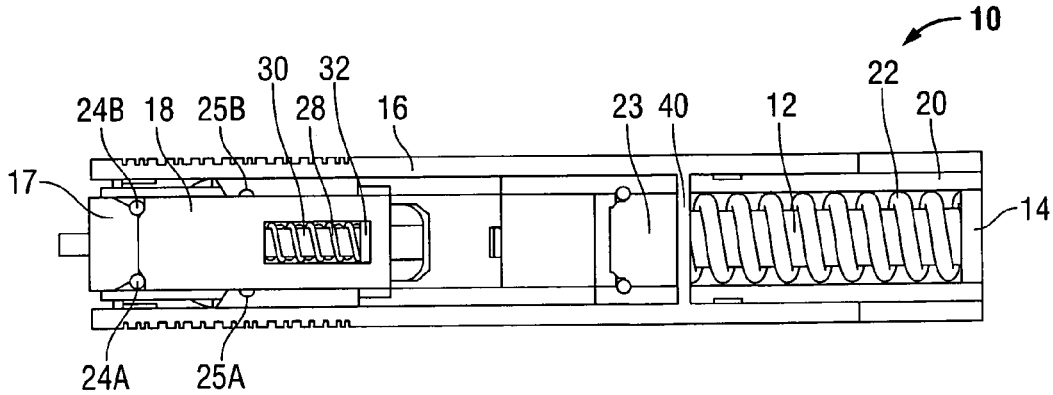
FIG. 1H depicts a top cross-sectional view of the firearm of FIG. 1A.

FIG. 1H shows a top cross-sectional view of the firearm (10) of FIG. 1E. As described previously, the grip slide (16) and chamber slide (18) are shown moved in a rearward direction relative to the recoil slide (20). Rearward movement of the grip slide (16) pulls the rear portion (17) thereof away from the chamber slide (18), allowing the roller pins (24A, 24B) to recess inward, disengaging the chamber slide (18) from the recoil slide (20). Specifically, FIG. 1H depicts the roller pins (24A, 24B) removed from corresponding notches (25A, 25B) within the recoil slide (20), thus enabling the chamber slide (18) to be moved freely relative thereto. As such, the recoil spring (22) is not compressed by movement of the chamber slide (18) and/or the grip slide (16), thus, the force applied by the recoil spring (22) need not be overcome to manually reload the firearm (10). The range of movement of the grip slide (16) relative to the recoil slide (20) can be limited by contact between the grip slide stop (40) and the plate (23). Movement of the chamber slide (18) and/or the grip slide (16) back to the battery position, shown in FIG. 1D (e.g., through manual movement or a force imparted by the grip slide spring (28) or chamber slide spring (36, shown in FIG. 1G)) can permit the roller pins (24A, 24B) to again engage the notches (25A, 25B) in the recoil slide (20), such that subsequent movement of the chamber slide (18) (e.g., caused by a recoil force) will also cause movement of the recoil slide (20).

Figure 1I:
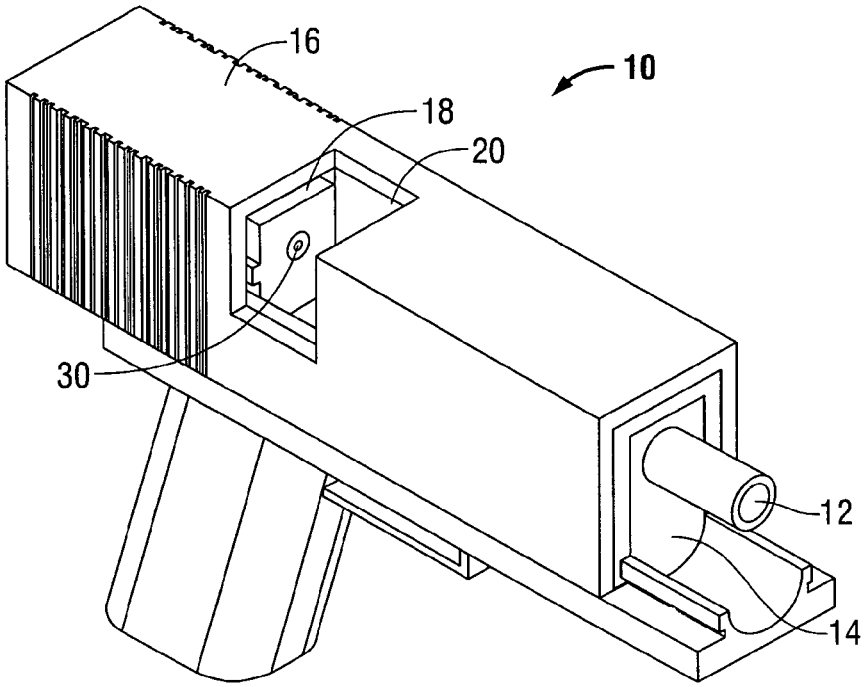
FIG. 1I depicts an isometric view of the firearm of FIG. 1A positioned after discharge thereof (e.g., under the effects of a recoil force).

FIG. 1I depicts an isometric view of the firearm (10) of FIG. 1A, positioned after discharge thereof (e.g., under the effects of a recoil force). As described previously, the firearm (10) includes a grip slide (16), a chamber slide (18), and a recoil slide (20), each moveable relative to the body of the firearm (10), e.g., in a rearward direction when affected by a manual force and/or a recoil force. FIG. 1I depicts the firearm (10) having the grip slide (16), the chamber slide (18), and the recoil slide (20) moved in a rearward direction relative to the body of the firearm (10), when compared to the battery position, shown in FIG. 1A.

Figure 1J:
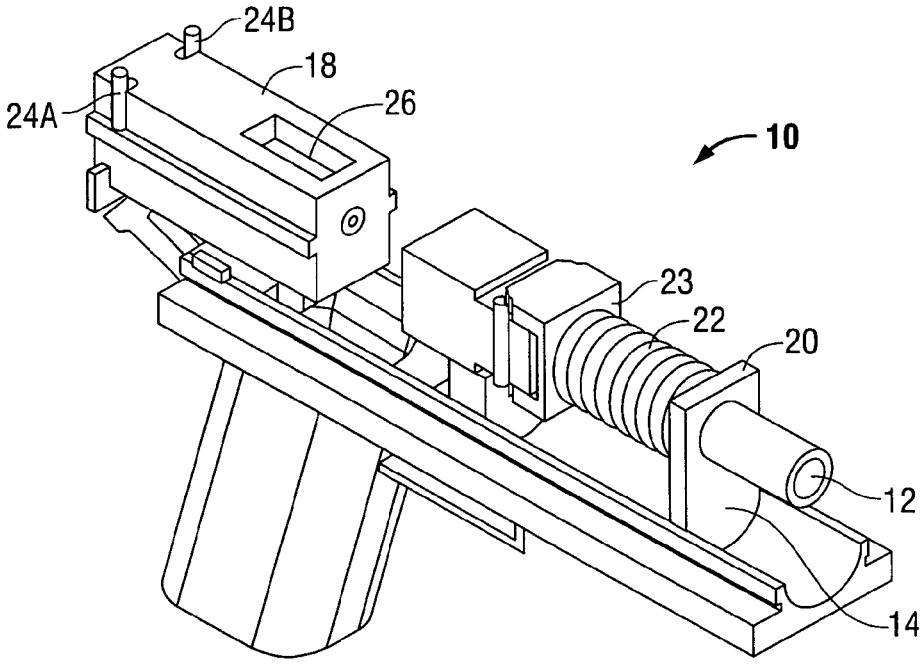
FIG. 1J depicts an isometric view of the firearm of FIG. 1I, having exterior portions removed to depict interior components thereof.

FIG. 1J depicts an isometric view of the firearm (10) of FIG. 1I, having the grip slide (16, shown in FIG. 1I) and portions of the recoil slide (20) that extend along the sides of the firearm (10) removed from view such that internal components of the firearm (10) can be visualized. The recoil spring (22) is shown disposed around the barrel (12) and compressed against the plate (23) by the front face (14) as the recoil slide (20, shown in FIG. 1I) is urged backward by a recoil force caused by discharging the firearm (10). The recoil spring (22) thereby provides an opposing counter-force to return the recoil slide (20), and the chamber slide (18) and grip slide (16) via their connection to the recoil slide (20), to the battery position, shown in FIGS. 1A through 1D. The two roller pins (24A, 24B) are shown extended from corresponding notches in the chamber slide (18), disposed in a position adapted to engage additional corresponding notches (25A, 25B, shown in FIG. 1H) in the recoil slide (20), thereby connecting the recoil slide (20) to the chamber slide (18). As such, the recoil slide (20), chamber slide (18), and grip slide (16, shown in FIG. 1I) move in unison under the effect of a recoil force, then toward the battery position under the effect of the recoil spring (22).

Figure 1K:
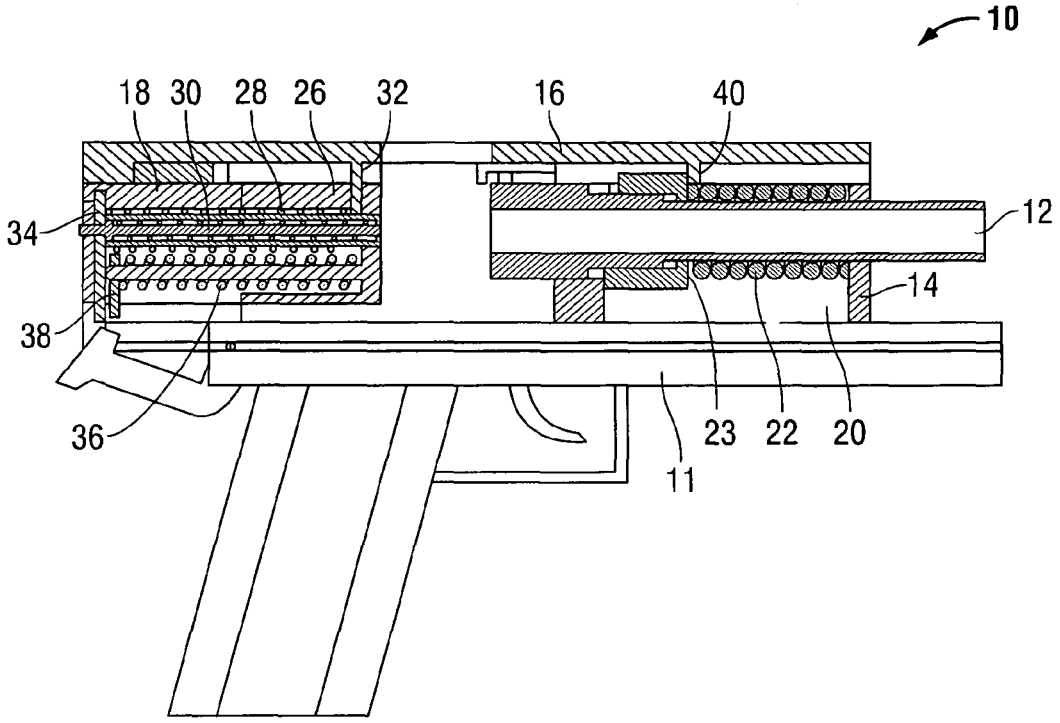
FIG. 1K depicts a side cross-sectional view of the firearm of FIG. 1I.

FIG. 1K depicts a side cross-sectional view of the firearm of FIG. 1I. As described previously, the firearm (10) includes three portions movable relative to the body (11) thereof: the grip slide (16), the chamber slick (18), and the recoil slide (20). Movement of the recoil slide (20) is resisted and/or biased by the recoil spring (22), while movement of the grip slide (16) and/or the chamber slide (18) is affected by the recoil spring (22) when the roller pins (24A, 24B, shown in FIG. 1J) are in a position that couples the chamber slide (18) to the recoil slide (20). As such, FIG. 1K depicts each of the recoil slide (20), the chamber slide (18), and the grip slide (16) disposed in a rearward position, each of the slides (16, 18, 20) moving as a single unit under application of a recoil force due to the connection between the chamber slide (18) and the recoil slide (20) (via the roller pins (24A, 24B, shown in FIG. 1J)).

Due to the fact that each of the slides (16, 18, 20) is moved concurrently via the recoil force, the grip slide (16) is not moved a significant distance relative to the chamber slide (18). Similarly, the chamber slide (18) is not moved a significant distance relative to the stop (38). Thus, during application of a recoil force, the depicted grip slide spring (28) and chamber slide spring (36) are not compressed.

Figure 1L:
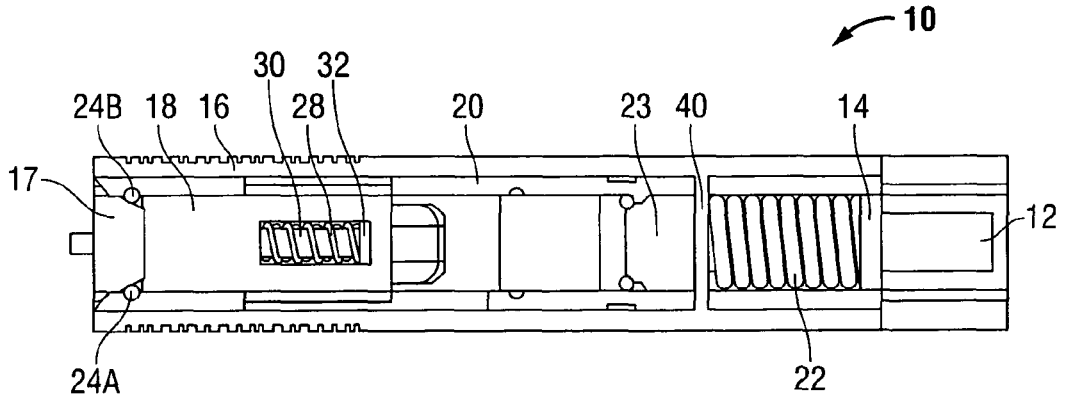
FIG. 1L depicts a top cross-sectional view of the firearm of FIG. 1I.

FIG. 1L depicts a top, cross-sectional view of the firearm (10) of FIG. 1I. As described above, the grip slide (16), chamber slide (18), and recoil slide (20) are depicted in a rearward position relative to the battery position shown in FIG. 1D, having been subjected to a recoil force. Each of the slides (16, 18, 20), moves in unison under the recoil force due to the connection between the chamber slide (18) and the recoil slide (20) via the roller pins (24A, 24B), which are retained in a position which connects the chamber and recoil slides (18, 20) due to the position of the rear portion (17) of the grip slide (16). As such, the grip slide (16) and chamber slide (18) do not move relative to the recoil slide (20), thus the grip slide spring (28) and chamber slide spring (36, shown in FIG. 1K) are not compressed. However, the recoil spring (22) is compressed by the recoil slide (20) during this movement, and biases each of the slides (16, 18, 20) toward the battery position due to the connection between the chamber slide (18) and the recoil slide (20).

Thus, in operation, the firearm (10) depicted in FIGS. 1A through 1I will generally exist in the battery position, shown in FIGS. 1A through 1D when unloaded. To manually load the firearm (10), the grip slide (16) can be pulled in a rearward direction. This rearward movement of the grip slide (16) moves the rear portion (17) thereof away from the chamber slide (18), permitting the roller pins (24A, 24B) to disengage from the corresponding notches (25A, 25B) of the recoil slide (20), thus disconnecting the chamber slide (18) from the recoil slide (20). Rearward movement of the grip slide (16) will also compress the grip slide spring (28) through contact between the grip slide spring (28) and the tab (32) of the grip slide (16), which extends into the opening (26) of the chamber slide (18) to engage the grip slide spring (28). Continued rearward movement of the grip slide (16) will cause movement of the chamber slide (18) through contact between the tab (32) and the end of the opening (26) and/or through another point of contact between the grip slide (16) and chamber slide (18), which compresses the chamber slide spring (36). When the chamber slide (18) reaches a position where the firearm (10) can be reloaded, the stop (40) of the grip slide (16) contacts the plate (23), preventing additional rearward movement. This position is depicted in FIGS. 1E through 1H. After the firearm (10) has been reloaded, the grip slide (16) can be released, and the associated grip slide spring (28) and chamber slide spring (36) will bias the grip and chamber slides (16, 18) toward the original battery position shown in FIGS. 1A through 1D. Thus, by permitting a manual rearward force applied to the grip slide (16) to disengage the chamber slide (18) from the recoil slide (20), compression of the recoil spring (22) is not required to manually reload the firearm (10).

When the firearm (10) is discharged, the recoil force produced urges the recoil slide (20) in a rearward direction. Due to the connection between the recoil slide (20) and the chamber slide (18) via the roller pins (24A, 24B), the chamber slide (18) and grip slide (16) are also simultaneously urged in a rearward direction concurrent with the recoil slide (20). Because the grip and chamber slides (16, 18) are not moved relative to the recoil slide (20), the grip slide spring (28) and chamber slide spring (36) are not compressed; however, movement of the recoil slide (20) compresses the recoil spring (22), such that the slides (16, 18, 20) of the firearm (10) are positioned in the orientation shown in FIGS. 1I through 1L. Due to the connection between the recoil slide (20) and the chamber slide (18), the counter-force applied by the recoil spring (22) reduces the recoil force felt by a user holding the firearm (10), and biases each of the slides (16, 18, 20) back toward the battery position, shown in FIGS. 1A through 1D.

Thus, the embodiments described above enable selective engagement between the recoil spring (22) and the chamber slide (18), depending on whether it is desired to manually reload the firearm (10), or to discharge the firearm (10) and resist recoil forces imparted thereto. As a result, the depicted recoil spring (22) can be significantly stronger than a conventional recoil spring, due to the fact that the manual force used to reload the firearm (10) will not be resisted by the recoil spring (22).

Referring now to FIGS. 2A through 2D, a firearm (50), having an embodiment of an apparatus usable within the scope of the present disclosure installed therein, is shown. Specifically, the firearm (50) includes an orifice sized to permit passage of the recoil spring therethrough, and two hinged doors movable to block the orifice. When the hinged doors are closed over the orifice, the firearm (50) is in battery, and when discharged, a recoil force will cause the recoil spring to be compressed against the hinged doors, reducing felt recoil and biasing the firearm (50) toward the battery position once more. When a movable portion (e.g., a grip slide) of the firearm (50) is manually manipulated, a locking mechanism can be actuated to permit the hinged doors to open, such that the recoil spring passes through the orifice. Thus, manual reloading of the firearm (50) is possible without compressing the recoil spring.

Figure 2A:
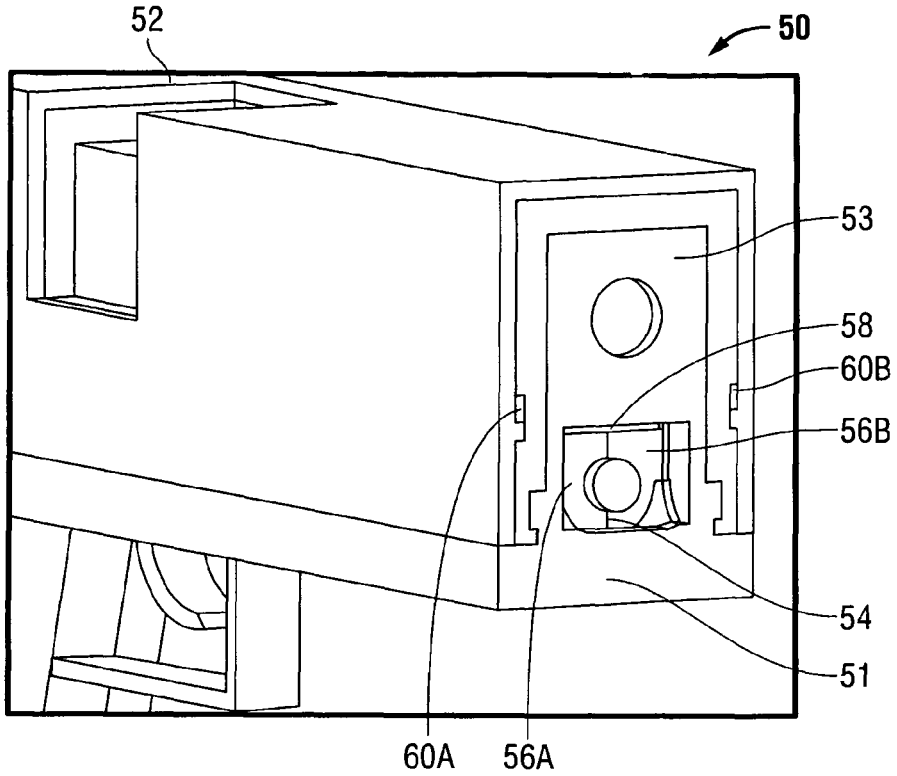
FIG. 2A depicts an isometric view of a firearm in battery, having an embodiment of an apparatus usable within the scope of the present disclosure.

FIG. 2A shows an isometric view of the firearm (50). Similar to the firearm depicted previously, in FIGS. 1A through 1L, the firearm (50) of FIG. 2A is shown as a semi-automatic pistol having a barrel, hilt, trigger and trigger guard, and other components known in the art. However, it should be understood that embodiments usable within the scope of the present disclosure can be used with any type of firearm having any desired components and characteristics.

The depicted firearm (50) includes a grip slide (52), movable relative to the body (51) of the firearm, e.g., in a rearward direction when it is desired to reload the firearm (50), and an orifice (54) in the front face (53) thereof, the orifice (54) being sized to permit passage of the recoil spring (not visible in FIG. 2A) therethrough. Two hinged doors (56A, 56B) are shown pivotally secured over the orifice (54), the hinged doors (56A, 56B) being selectively openable to permit passage of the recoil spring through the orifice (54) (e.g., during manual reloading) and closeable to prevent passage of the recoil spring (e.g., during discharge and recoil). A locking member (58) having two side portions (60A, 60B) secures the hinged doors (56A, 56B) in the closed position, depicted in FIG. 2A. Manual movement of the grip slide (52) can raise the side portions (60A, 60B) (e.g., through contact between the side portions (60A, 60B) and a protrusion, incline, and/or curvature of the grip slide (52) positioned to raise the side portions (60A, 60B)), thus raising the locking member (58) and permitting the hinged doors (60A, 60B) to open when contacted by the recoil spring. Conversely, when the firearm (50) is discharged, the locking member (58) remains in the lowered position, shown in FIG. 2A, which prevents the hinged doors (56A, 56B) from opening. As a result, the recoil spring is compressed against the hinged doors (56A, 56B) to reduce the recoil force felt by a user and bias the firearm (50) toward the battery position.

Figure 2B:
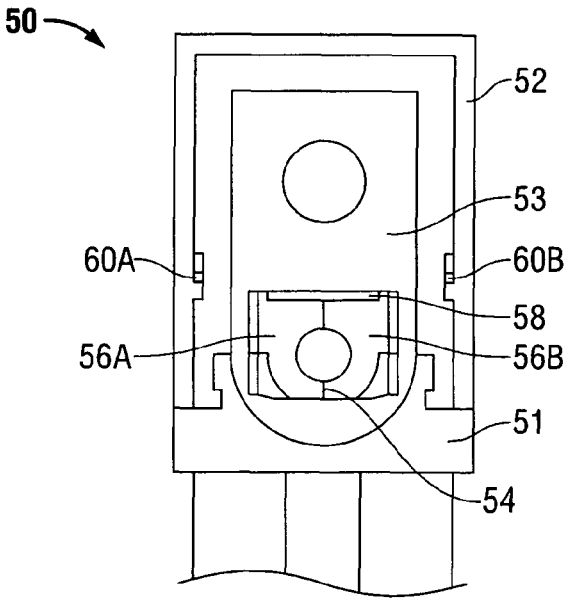
FIG. 2B depicts a front view of the firearm of FIG. 2A.

FIG. 2B depicts a front view of the firearm (50) of FIG. 2A, showing the hinged doors (56A, 56B) disposed over the orifice (54). The locking member (58) is depicted covering a top portion of the hinged doors (56A, 56B) such that the hinged doors (56A, 56B) will not open when contacted by the recoil spring during discharge of the firearm (50). As described previously, however, manual movement of the grip slide (52) can raise the side portions (60A, 60B) of the locking member (58), thus permitting the hinged doors (56A, 56B) to open when rearward movement of the grip slide (52) causes the recoil spring to contact the interior of the hinged doors (56A, 56B).

Figure 2C:
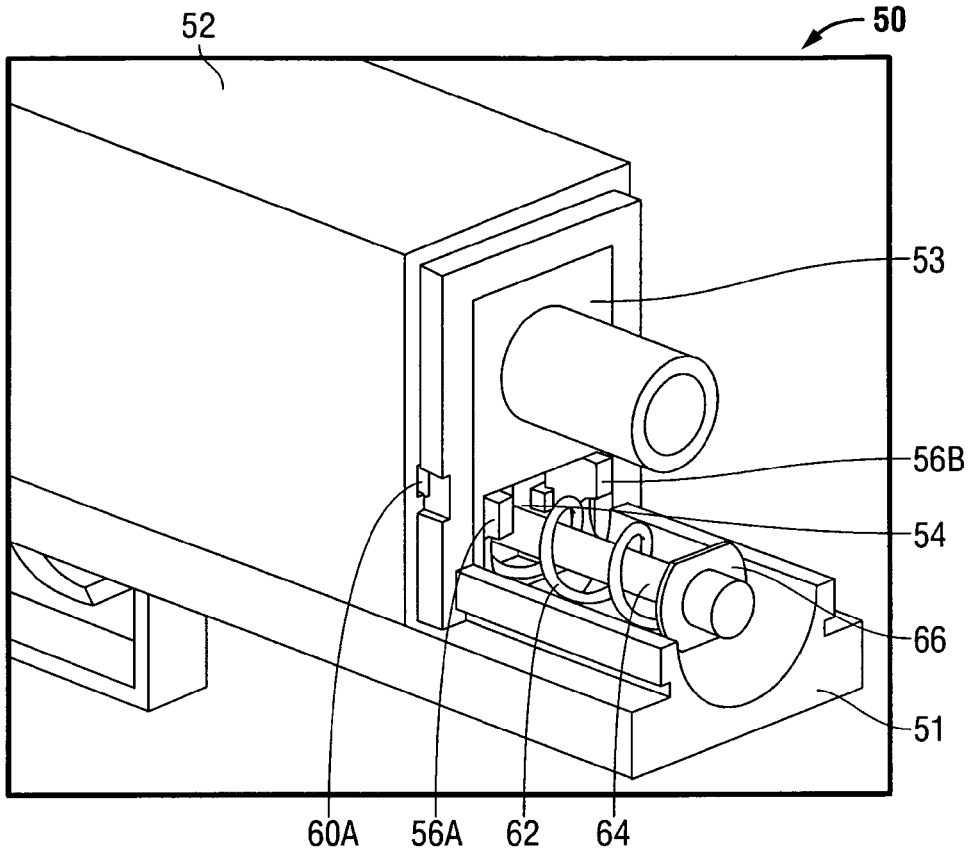
FIG. 2C depicts an isometric view of the firearm of FIG. 2A positioned for manual chambering thereof.

FIG. 2C depicts an isometric view of the firearm (50) of FIG. 2A positioned for manual chambering (e.g., reloading) thereof. To enable reloading of the firearm (50), the grip slide (52) can be moved in a rearward direction relative to the body (51). As described above, movement of the grip slide (52) in this manner can cause a portion of the grip slide (52) to interact with (e.g., raise) the side portions (60A, 60B) of the locking member (58) such that the locking member (58) does not cover the hinged doors (56A, 56B) at the time the hinged doors (56A, 56B) are contacted by the recoil spring (62). FIG. 2C depicts the recoil spring (62) secured around a rod or pin (64) and having an actuator disc (66) at the distal end thereof. When the grip slide (52) is manually moved relative to the body (51) and the locking member (58) is thereby raised, the actuator disc (66) and/or another portion of the recoil spring (62) or pin (64) contacts an interior portion (e.g., a tab or similar surface) of the hinged doors (56A, 56B) and causes the hinged doors (56A, 56B) to pivot to the open position, shown in FIG. 2C. The recoil spring (62) is then able to pass through the orifice (54) and is thereby not compressed by the manual force imparted to the grip slide (52). As such, manual chambering of the firearm (50) is possible without requiring the force imparted by the recoil spring (62) to be overcome. When the grip slide (52) is returned to the battery position, shown in FIG. 2A, whether through a manual force or use of a biasing member, such as a spring, the actuator disc (66) and/or a similar member can contact the hinged doors (56A, 56B) and return the hinged doors (56A, 56B) to the closed position. Alternatively and/or additionally, the hinged doors (56A, 56B) can be biased toward the open position or the closed position, contacted by a member in communication with the recoil spring (62) to move the hinged doors (56A, 56B) to the non-biased position, and retained in either position by the locking member (58).

During discharge of the firearm (50), the resulting recoil force will move the grip slide (52) in a rearward direction; however, the locking member (58) would remain in a lowered position during discharge, covering the hinged doors (56A, 56B). As such, when the recoil spring (62) and/or the pin (64) or actuator disc (66) contact the hinged doors (56A, 56B), the hinged doors (56A, 56B) remain closed and the recoil spring (62) is compressed, thereby reducing the recoil force felt by the user and biasing the grip slide (52) toward the battery position.

Figure 2D:
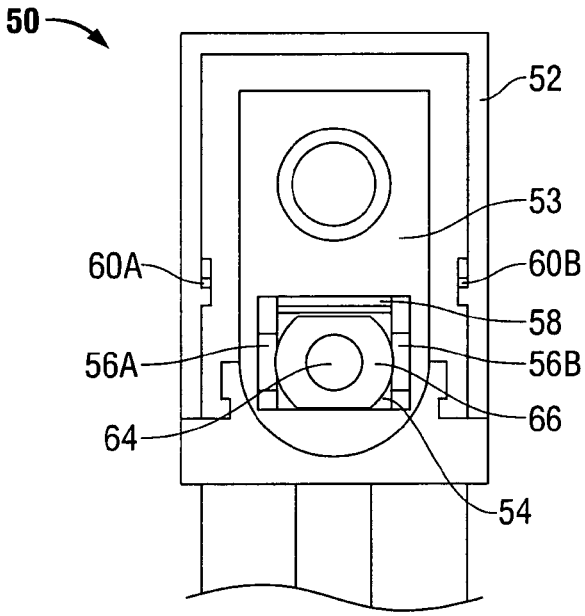
FIG. 2D depicts a front view of the firearm of FIG. 2C.

FIG. 2D depicts a front view of the firearm (50) of FIG. 2C, showing the hinged doors (56A, 56B) in an open position for allowing passage of the recoil spring (62, shown in FIG. 2C), the actuator disc (66), and the pin (64) to pass through the orifice (54). FIG. 2D depicts the locking member (58) in a lowered position after passage of the recoil spring through the orifice (54), illustrating that movement of the grip slide (52) need only raise the locking member (58) during the time that the hinged doors will pivot between the open and closed positions.

In operation, the firearm (50) depicted in FIGS. 2A through 2D will typically be in the battery position, shown in FIGS. 2A and 2B, when unloaded. To manually reload the firearm (50), the grip slide (52) can be moved in a rearward direction relative to the body (51), which will cause the locking member (58) to be raised. While the locking member (58) is raised, the actuator disc (66), pin (64), and/or the recoil spring (62) or another associated member can contact the interior of the hinged doors (56A, 56B), causing the hinged doors (56A, 56B) to pivot open and permit passage of the recoil spring through the orifice (54). Thus, compression of the recoil spring (62) is not required to manually reload the firearm 50).

When the firearm (50) is discharged, the locking member (58) will remain in front of the hinged doors (56A, 56B), such that contact between the recoil spring (62) and the hinged doors (56A, 56B) will not cause the hinged doors (56A, 56B) to open. Instead, the recoil spring (62) will be compressed against the hinged doors (56A, 56B), decreasing the recoil force felt by a user and biasing the firearm (50) toward the battery position.

It should be understood that while FIGS. 2A through 2D depict pivotable and/or hinged doors, other types of movable members can be used to partially or wholly cover the orifice. Additionally, while FIGS. 2A through 2D depict a locking member that covers an upper portion of the hinged doors, other types and/or orientations of locking members that move concurrent with movement of the grip slide can be used. Further, other types of actuators that move or otherwise cause a portion of the firearm to be moved concurrent with manual movement of the grip slide and/or discharge of the firearm are also usable without departing from the scope of the present disclosure.

Referring now to FIGS. 3A through 3D, a firearm (70), having an embodiment of an apparatus usable within the scope of the present disclosure installed therein, is shown. Specifically, the firearm (70) includes an orifice sized to permit passage of the recoil spring therethrough, and a sliding door movable to block a portion of the orifice. When in battery, the sliding door does not block the orifice, and a movable portion (e.g., a grip slide) of the firearm (70) can be manipulated to reload the firearm (70) while the recoil spring passes through the orifice. The depicted firearm (70) includes a gas actuation system in communication with the barrel such that when the firearm (70) is discharged, gas produced during the discharge actuates the sliding door to cover the orifice, such that the recoil spring is compressed against the sliding door, reducing felt recoil and biasing the firearm (70) toward the battery position.

Figure 3A:
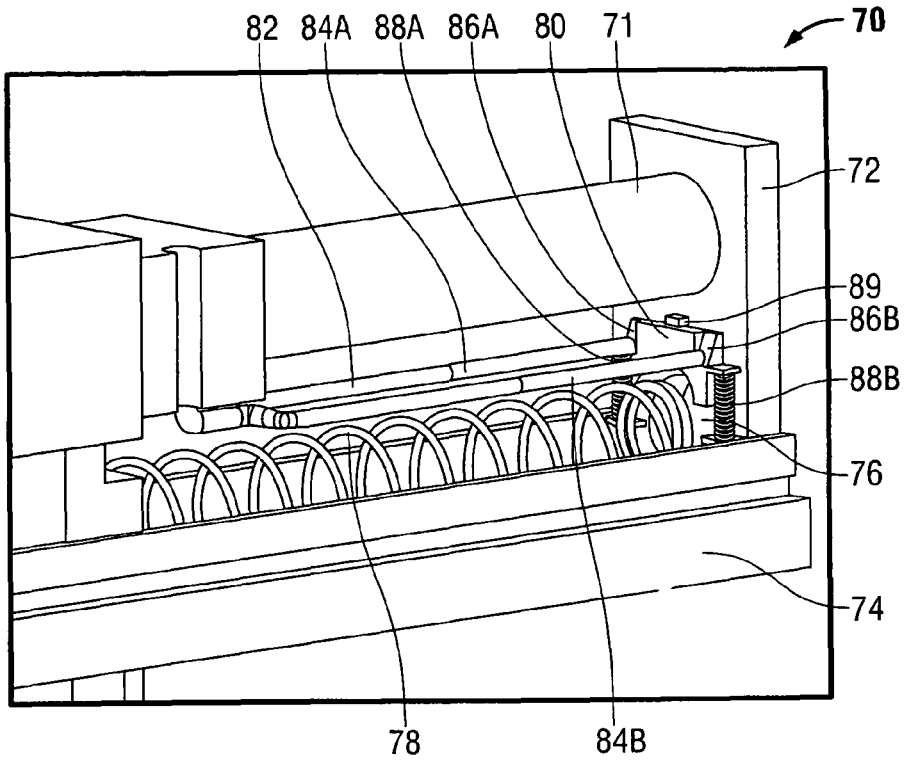
FIG. 3A depicts an isometric view of a firearm in battery, having an embodiment of an apparatus usable within the scope of the present disclosure, with exterior portions removed to depict interior portions thereof.

FIG. 3A depicts an isometric view of the firearm (70), having exterior portions thereof removed to enable visualization of the interior components. Similar to the firearms depicted previously, in FIGS. 1A through 2D, the firearm (70) of FIG. 3A is shown as a semiautomatic pistol having a barrel (71), hilt, trigger and trigger guard, and other components known in the art. However, as described above, it should be understood that embodiments usable within the scope of the present disclosure can be used with any type of firearm having any desired components and characteristics.

The depicted firearm (70) can include a grip slide (omitted from FIG. 3A for clarity), movable relative to the body (74) thereof, e.g., when it is desired to manually reload the firearm (70). Specifically, FIG. 3A depicts the firearm (70) in the battery position, having an orifice (76) in the front face (72) thereof that is sized to permit passage of the recoil spring (78) therethrough. When the grip slide is manually moved in a rearward direction, the recoil spring (78) passes through the orifice (76), thus, manual reloading of the firearm (70) is possible without compressing the recoil spring (78).

The firearm (70) is also shown including a sliding door (80), which is movable to cover a portion off the orifice (76) to prevent passage of the recoil spring (78) therethrough, e.g., during discharge of the firearm (70). The depicted sliding door (80) is shown positioned above the orifice (76) and is movable in a downward direction to cover an upper portion of the orifice (76). Springs (88A, 88B) or similar biasing members can be used to retain the sliding door (80) in the raised position, the upward movement of the sliding door (80) being limited by a stop (89). One or more pistons (84A, 84B) can be used to urge the sliding door (80) toward a lowered position by contacting curved and/or angled surfaces (86A, 86B) of the sliding door (80). Specifically, the firearm (70) is shown including a gas return tube (82) in communication with the barrel (71) thereof, such that when the firearm (70) is discharged, gas produced through the discharge travels through the gas return tube (82) and urges the pistons (84A, 84B) toward the sliding door (80), thereby lowering the sliding door (80) to cover a portion of the orifice (76) before the recoil force imparted to the firearm (70) causes movement of the slide thereof relative to the body (74). Thus, discharge of the firearm (70), via the depicted gas return system, can be used to actuate the sliding door (80) and cause compression of the recoil spring (78) against the sliding door (80) when it is desired to resist a recoil force, while manual movement of the slide to reload the firearm (70) remains generally unaffected by the recoil spring (78).

Figure 3B:
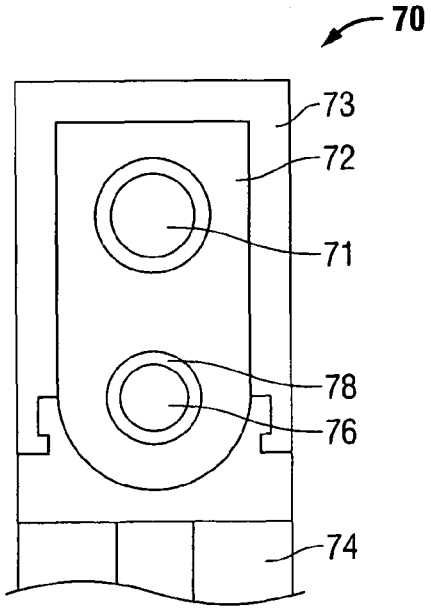
FIG. 3B depicts a front view of the firearm of FIG. 3A.

FIG. 3B depicts a front view of the firearm (70) of FIG. 3A, showing the barrel (71), front face (72), grip slide (73), and body (74). The orifice (76) is shown in an open position, unobstructed by the sliding door, such that the recoil spring (78) can freely pass therethrough when the grip slide (73) is moved relative to the body (74).

Figure 3C:
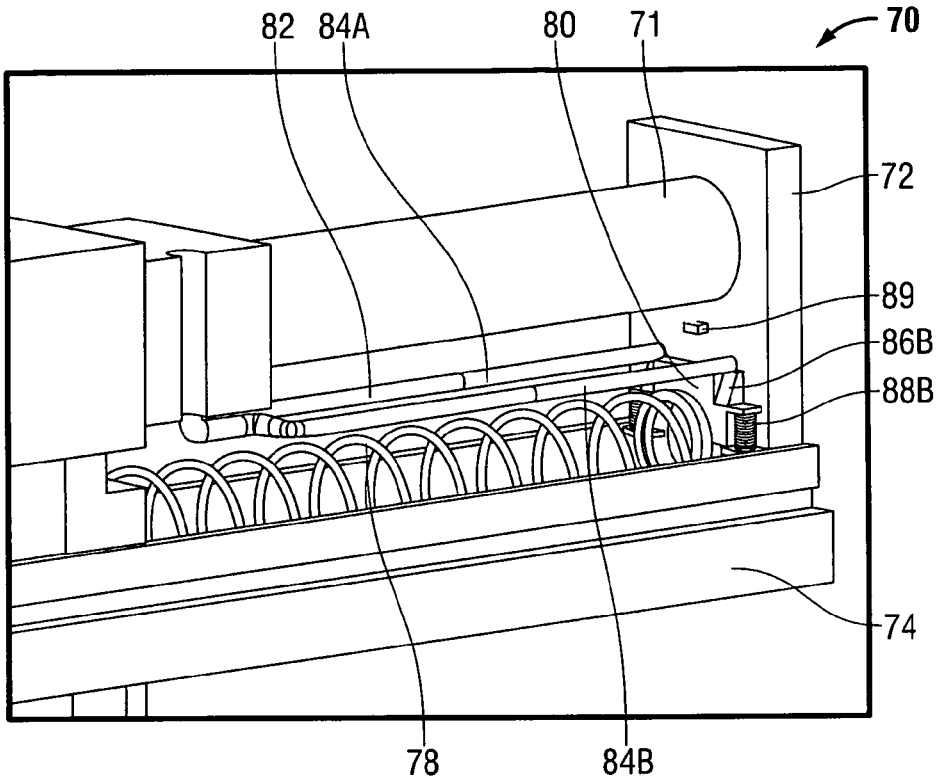
FIG. 3C depicts an isometric view of the firearm of FIG. 3A positioned after discharge thereof (e.g., under the effects of a recoil force).

FIG. 3C depicts an isometric view of the firearm (70) of FIG. 3A during discharge thereof. During discharge, gas produced flows into the gas return tube (82), shown in communication with the barrel (71). This gas contacts the two pistons (84A, 84B) shown at the distal end of the gas return tube (82), urging the pistons (84A, 84B) outward (e.g., toward the front face (72)), such that the pistons (84A, 84B) contact the curved and/or angled surfaces (86A, 86B) of the sliding door (80). This contact causes downward movement of the sliding door (80), compressing the springs (88A, 88B), thereby covering a portion of the orifice (76, shown in FIG. 3A). When the orifice (76) is obstructed by the sliding door (80), passage of the recoil spring (78) therethrough is prevented, thus the recoil spring (78) is compressed against the sliding door (80) during recoil of the firearm (70), reducing the portion of the recoil force felt by a user and biasing the firearm (70) toward the battery position shown in FIGS. 3A and 3B. After discharge of the firearm (70), the springs (88A, 88B) can return the sliding door (80) to the raised position, shown in FIG. 3A, and the pistons (84A, 84B) can be urged backward through contact with the sliding door (80).

Figure 3D:
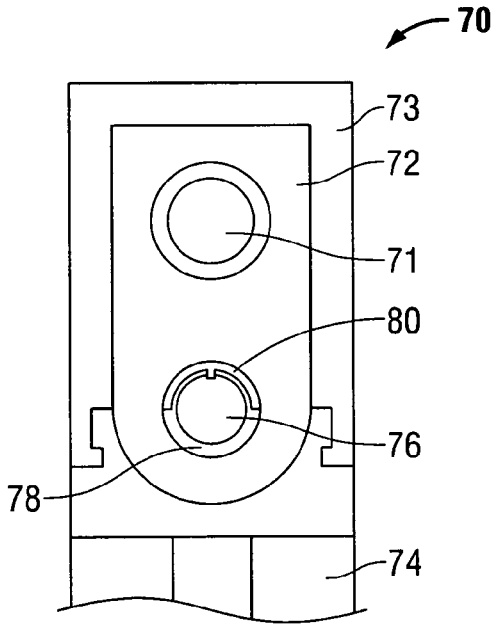
FIG. 3D depicts a front view of the firearm of FIG. 3C.

FIG. 3D depicts a front view of the firearm (70) of FIG. 3C, showing the barrel (71), front face (72), grip slide (73), and body (74). The orifice (76) is shown having an upper portion thereof obstructed by the sliding door (80), such that the recoil spring (78) cannot pass therethrough. Movement of the grip slide (73) under application of a recoil force thereby causes the recoil spring (78) to be compressed against the sliding door (80), resisting the recoil force.

Thus, in operation, the firearm (70) shown in FIGS. 3A through 3D can be manually manipulated for chambering thereof (e.g., through rearward movement of the grip slide (73)) without such movement being affected by the recoil spring (78). The recoil spring (78) passes freely through the orifice (76) unless the orifice (76) is obstructed by the sliding door (80). The sliding door (80) is moved to obstruct the orifice only when the firearm (70) is discharged, causing the pistons (84A, 84B) to be urged against the sliding door (80) by gas flowing through the gas return tube (82), thereby moving the sliding door (80) over the orifice (76).

It should be understood that while FIGS. 3A through 3D depict a single sliding door, movable between a raised position and a lowered position that partially covers the orifice, various embodiments usable within the scope of the present disclosure can include one or multiple members, that can be moved in and from any direction, to cover all or any portion of the orifice.

Additionally, it should be understood that while FIGS. 3A through 3D depict a sliding door, with basic modifications readily understood by those skilled in the art, the hinged doors shown in FIGS. 2A through 2D could be adapted to operate with the gas return system shown in FIGS. 3A through 3D. Further, the sliding door shown in FIGS. 3A through 3D could be adapted to operate with the locking member, shown in FIGS. 2A through 2D. In summary, while the present disclosure describes numerous exemplary embodiments, it should be understood that any type of movable member can be used in combination with any type of actuator without departing from the scope of the present disclosure.

Referring now to FIGS. 4A through 4H, a firearm (90), having an embodiment of an apparatus usable within the scope of the present disclosure installed therein, is shown. The depicted firearm (90) includes an orifice sized to permit passage of the recoil spring therethrough, and an "iris" or similar diameter-reducing assembly placed around the orifice, the assembly having a plurality of members that are movable to block a portion of the orifice. When in battery, the members do not block the orifice, and a movable portion (e.g., a grip slide) of the firearm (90) can be moved in a rearward direction to reload the firearm (90) while the recoil spring passes through the orifice. The depicted firearm (90) includes a trigger actuation system, in which the trigger is connected to the diameter-reducing assembly, such that when the firearm is discharged, movement of the trigger actuates the members of the diameter-reducing assembly to cover a portion of the orifice. When the orifice is covered, the recoil spring cannot pass therethrough, and the recoil spring is thereby compressed against the movable members to reduce the recoil force felt by a user and bias the firearm toward the battery position.

Figure 4A:
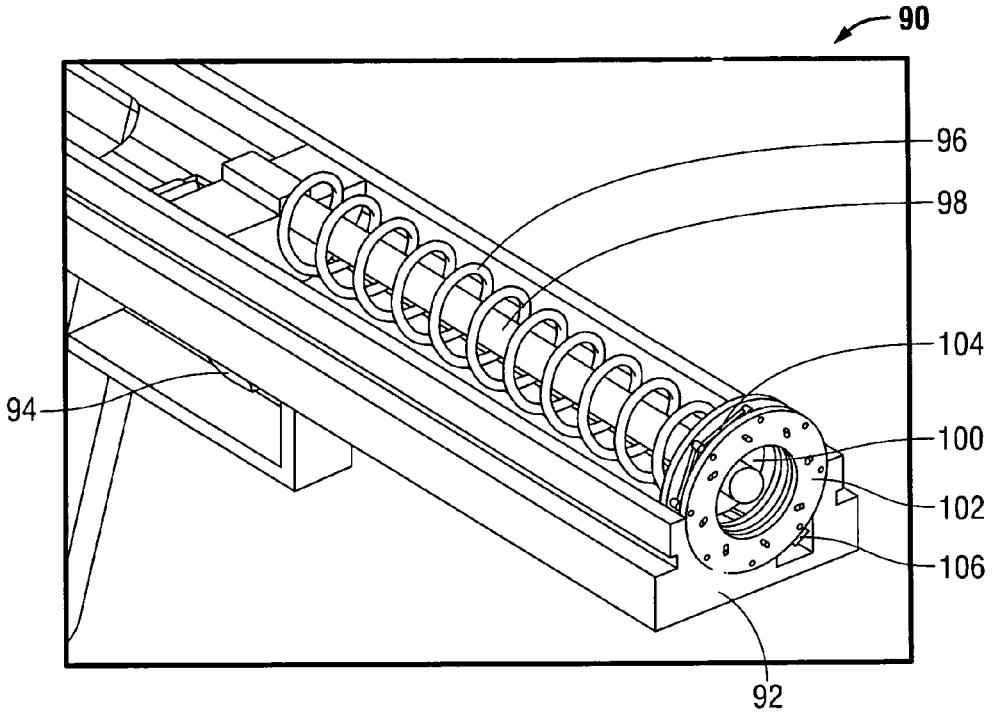
FIG. 4A depicts an isometric view of a firearm in battery, having an embodiment of an apparatus usable within the scope of the present disclosure, with exterior portions removed to depict interior portions thereof.

FIG. 4A depicts an isometric view of the firearm (90), having the grip slide and/or other exterior portions thereof removed to enable visualization of the interior components. The firearm (90) of FIG. 4A is shown as a semiautomatic pistol having a barrel, hilt, trigger (94) and trigger guard, and other components known in the art. However, as described previously, it should be understood that embodiments usable within the scope of the present disclosure can be used with any type of firearm having any desired components and characteristics.

The firearm (90) can include a grip slide (omitted from FIG. 4A for clarity), that is movable relative to the body (92) thereof, such as when it is desired to manually chamber (e.g., reload) the firearm (90), and a recoil spring (96), shown disposed about a guide rod (98), which can be compressed when the firearm (90) is discharged to resist the resulting recoil force and bias the firearm (90) toward the depicted battery position. The firearm (90) is shown having an orifice (100) in the front face thereof (e.g., beneath the barrel), the orifice (100) being sized to permit passage of the recoil spring (96) therethrough. Thus, when the grip slide is moved in a rearward direction, the recoil spring (96) passes through the orifice (100), enabling manual reloading of the firearm (90) without compressing the recoil spring (96).

The depicted firearm (90) is shown including an iris assembly (102) disposed about the orifice (100). The iris assembly (102) includes a plurality of movable members (104) movable into and from the orifice (100) to cover a portion of the orifice (100). When the movable members (104) obstruct the orifice (100), the recoil spring (96) cannot pass therethrough, thus, when the firearm (90) is discharged, the recoil spring (96) will be compressed against the movable members (104), reducing the recoil force felt by the user and biasing the firearm (90) toward the battery position. The iris assembly (102) is shown including a tab (106) at the exterior thereof, which is connected to the trigger (94) of the firearm (90), such that actuation of the trigger causes rotation of the tab (106), thus moving the movable members (104) of the iris assembly (102) to cover the orifice (100). (The iris assembly (102) and trigger actuation system are shown in greater detail in FIGS. 4E through 4H.) Thus, discharge of the firearm (90), itself, can be used to actuate the movable members (104) via movement of the trigger (94), to cause compression of the recoil spring (96) against the movable members (104) when it is desired to resist a recoil force, while manual movement of the grip slide to reload the firearm (90) remains generally unaffected by the recoil spring (96).

Figure 4B:
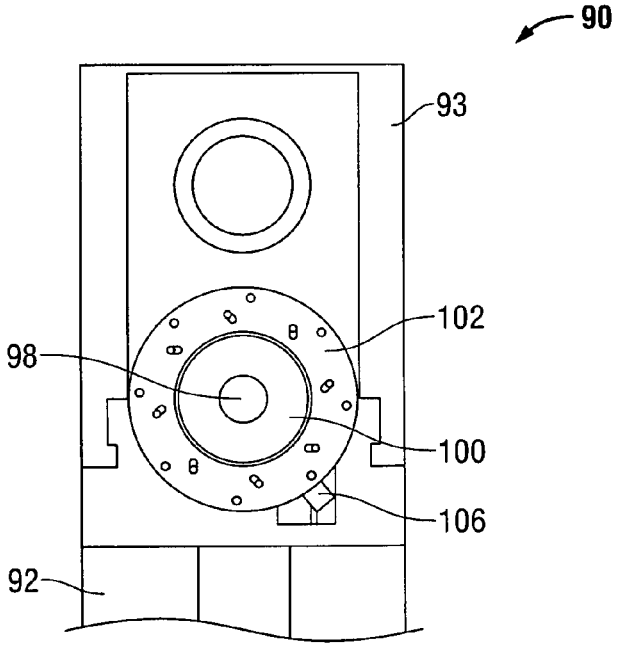
FIG. 4B depicts a front view of the firearm of FIG. 4A.

FIG. 4B depicts a front view of the firearm (90) of FIG. 4A, showing the slide (93), body (92), and the orifice (100) in an open, unobstructed position, such that the recoil spring can freely pass therethrough when the slide (93) is moved relative to the body (92).

Figure 4C:
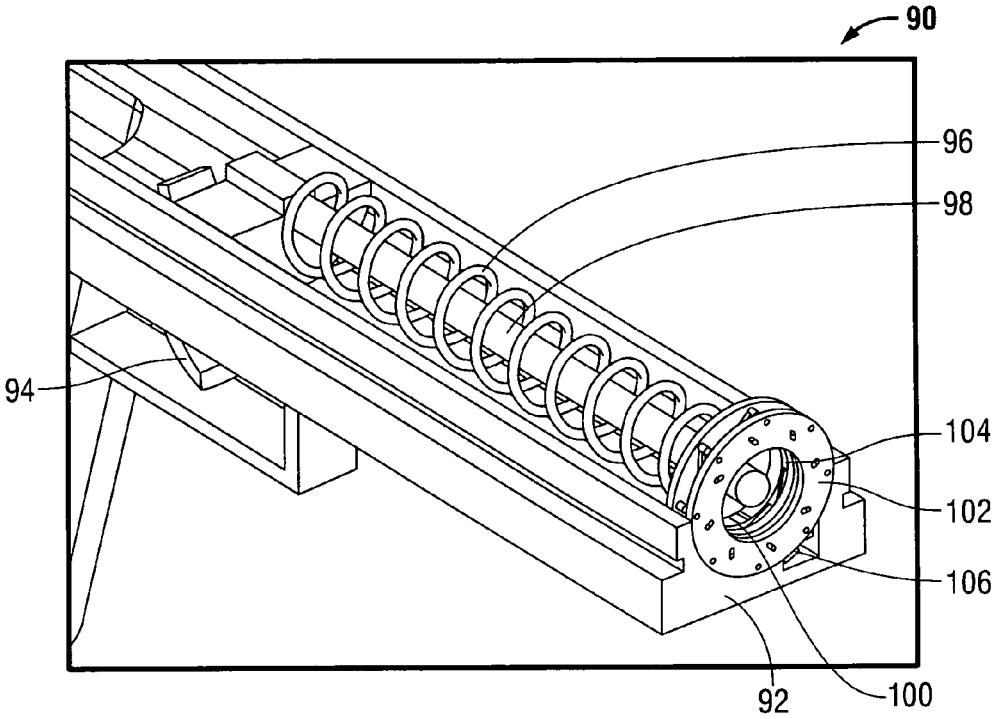
FIG. 4C depicts an isometric view of the firearm of FIG. 4A positioned to withstand a recoil force (e.g., prepared for discharge thereof).

FIG. 4C depicts an isometric view of the firearm (90) of FIG. 4A during discharge thereof. As the firearm (90) is discharged, movement of the trigger (94) causes movement of the tab (106) of the iris assembly (102), via a connection thereto, which rotates the iris assembly (102) to position the movable members (104) within the orifice (100), e.g., around the outer circumference thereof, thereby reducing the effective diameter of the orifice (100). As such, discharge of the firearm (90) will cause compression of the recoil spring (96) against the movable members (104), thereby resisting the recoil force and biasing the firearm (90) toward the battery position.

Figure 4D:
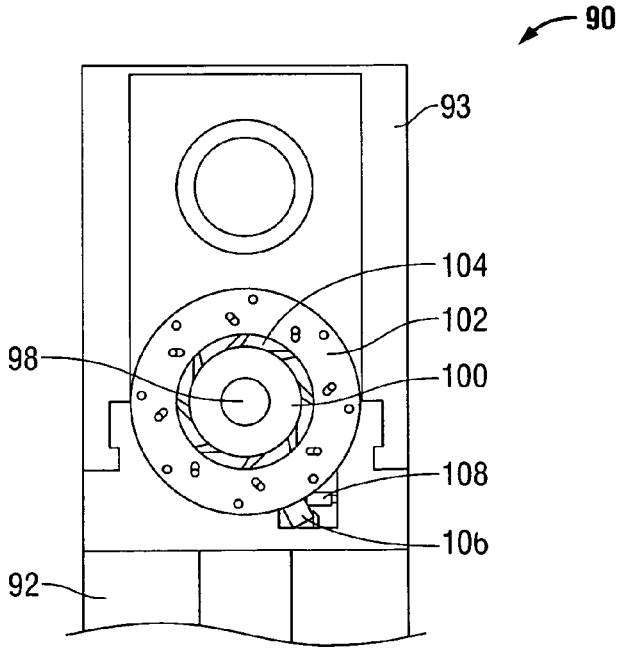
FIG. 4D depicts a front view of the firearm of FIG. 4C.

FIG. 4D depicts a front view of the firearm (90) of FIG. 4C, showing the slide (93), body (92), and orifice (100), as described previously. The movable members (104) are shown positioned within and partially obstructing the orifice (100) to prevent passage of the recoil spring therethrough. Thus, movement of the slide (93) under application of a recoil force thereby causes the recoil spring to be compressed against the movable members (104), resisting the recoil force. An actuator (108) in communication with the trigger and the tab (106)

is also shown. Movement of the trigger to discharge the firearm causes movement of the actuator (108), which in turn causes movement of the tab (106) to rotate the iris assembly (102), causing the movable members (104) to obstruct the orifice (100).

Figure 4E:
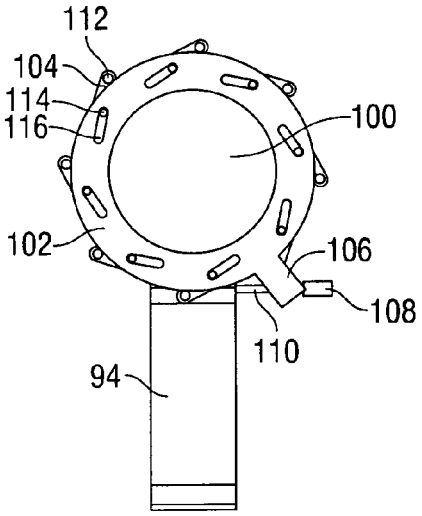
FIG. 4E depicts a diagrammatic front view of a contact member and actuator of the apparatus of FIG. 4A in battery.

FIG. 4E depicts a diagrammatic front view of the iris assembly (102) disposed about the orifice (100) and engaged with the trigger (94). Specifically, FIG. 4E depicts the iris assembly (102) in an open position, in which the movable members (104) do not overlap the orifice (100), thus permitting the recoil spring to pass therethrough. FIG. 4E depicts an exemplary configuration of the iris assembly (102), in which each movable member (104) includes an outer pin (112) that moves along the outer circumference of the iris assembly (102) as the tab (106) is rotated, and an inner pin (114), which extends through a corresponding slot (116) in the body of the iris assembly (102). The depicted actuator (108) is connected to the tab (106) via a generally horizontal connector (110), along which the actuator (108) is horizontally and/or slidably movable. Thus, actuation of the trigger (94) will cause movement of the actuator (108), which contacts the tab (106) to rotate the iris assembly (102). Rotation of the iris assembly (102) relative to the movable members (104) is permitted due to engagement between the inner pins (114) and the slots (116), the length of the slots providing a desired range of motion to the body of the iris assembly (102).

Figure 4G:
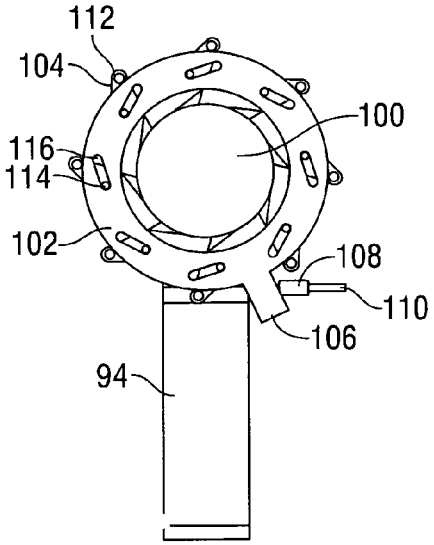
FIG. 4G depicts a diagrammatic front view of the contact member and actuator of FIG. 4E positioned to withstand a recoil force.
Figure 4F:
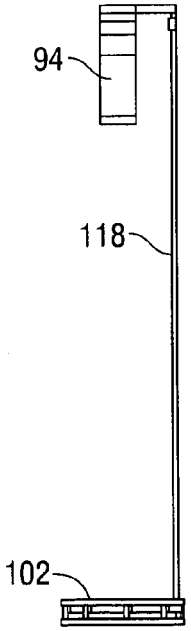
FIG. 4F depicts a diagrammatic top view of the contact member and actuator of FIG. 4E.

FIG. 4F depicts a top view of the iris assembly (102) and trigger actuation system, shown in FIG. 4E. A connector (118) extending linearly (e.g., generally perpendicular to the iris assembly (102) and the trigger (94)) between the iris assembly (102) (e.g., the actuator (108) and or the connector (110), shown in FIG. 4E) and the trigger (94) is shown. Movement of the trigger (94) thereby causes movement of the iris assembly (102) via this connection.

FIG. 4G depicts a diagrammatic front view of the iris assembly (102) of FIG. 4E in a closed position, e.g., after rotation of the tab (106) via actuation of the trigger (94). Rotation of the iris assembly (102) and/or corresponding movement of the movable members (104) positions the movable members (104) within the orifice (100), effectively reducing the diameter thereof to prevent passage of the recoil spring therethrough. As shown, contact between the actuator (108) and the tab (106) causes movement of the tab and corresponding movement of the body of the iris assembly (102).

Figure 4H:
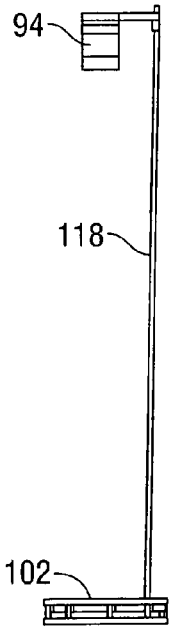
FIG. 4H depicts a diagrammatic top view of the contact member and actuator of FIG. 4F.

FIG. 4H depicts a top view of the iris assembly (102) and trigger actuation system, shown in FIG. 4G. The connector (118) is shown extending at an angle between the iris assembly (102) and the trigger (94), illustrating that movement of the trigger (94) can cause a corresponding movement of the connector (118), and thereby cause movement of the actuator (108), tab (106), and iris assembly (102).

Thus, in operation, the firearm (90) shown in FIGS. 4A through 4H can be manually manipulated for reloading, e.g., through movement of the slide (93) relative to the body (92), without such movement being affected by the recoil spring (96). The recoil spring (96) passes freely through the orifice (100) unless the orifice (100) is obstructed by the movable members (104). The movable members (104) obstruct the orifice (100) only when the trigger (94) is moved to discharge the firearm (90), which causes movement of the iris assembly (102) and/or the movable members (104) via a connection to the trigger.

It should be understood that while FIGS. 4A through 4H depict an exemplary embodiment of an iris assembly (102) and an exemplary arrangement of a system in which movement of the trigger (94) can actuate the iris assembly (102), various other configurations in which one or more portions of an assembly can be moved to cover the orifice (100) can be used, and similarly, other methods of engagement between the trigger (94) and the iris assembly (102) can be readily recognized by a person skilled in the art without departing from the scope of the present disclosure.

Additionally, it should be understood that while FIGS. 4A through 4H depict an iris assembly actuated by movement of the trigger, the hinged doors shown in FIGS. 2A through 2D could be adapted to operate with the trigger actuation system of FIGS. 4A through 4H. Similarly, the sliding door shown in FIGS. 3A through 3D could be adapted to operate with the trigger actuation system. Alternatively, the iris assembly of FIGS. 4A through 4H could be adapted to operate with the locking member of FIGS. 2A through 2D or the gas return system of FIGS. 3A through 3D. In summary, while the present disclosure describes numerous exemplary embodiments and combinations of elements, it should be understood that any type of movable member can be used in combination with any type of actuator without departing from the scope of the present disclosure.

Embodiments described herein thereby provide systems and methods in which a recoil spring or similar elastic member in communication with a slide or similar portion of a firearm can be selectively compressed during discharge of the firearm and application of a recoil force, while manual movement of the slide will not compress the spring. Embodied systems and methods can thereby provide firearms with an easier cocking action, enabling users to efficiently and easily chamber the firearm, including users having limited strength. Additionally, due to the fact that the recoil spring is not compressed during manual chambering, stronger recoil springs can be used to resist the recoil force felt by a user.

While various embodiments of the present invention have been described with emphasis, it should be understood that within the scope of the appended claims, the present invention might be practiced other than as specifically described herein.

What is claimed is:

1. An apparatus for facilitating reloading of a firearm, wherein the firearm has a length extending between a front end of the firearm adjacent a barrel and a back end of the firearm, the apparatus comprising:

an elastic member, wherein the elastic member is in communication with a moveable portion of the firearm, wherein the moveable portion comprises a recoil slide and a chamber slide, wherein the recoil slide extends about the elastic member and along the exterior of the chamber slide;

at least one contact member, wherein the at least one contact member is moveable between a first position connecting the chamber slide and the recoil slide, whereby movement of the chamber slide is biased by the elastic member, and a second position disconnecting the chamber slide from the recoil slide, whereby movement of the chamber slide is generally unaffected by the elastic member; and an actuator in communication with the at least one contact member for moving the at least one contact member between the first position and the second position.

2. The apparatus of claim 1, wherein the actuator comprises a grip slide moveable relative to the moveable portion of the firearm, wherein movement of the grip slide in a first direction relative to the moveable portion of the firearm causes movement of the at least one contact member toward the second position, and wherein movement of the grip slide in a second direction relative to the moveable portion of the firearm causes movement of the at least one contact member toward the first position.

3. The apparatus of claim 1, wherein the moveable portion of the firearm comprises an additional elastic member, for biasing movement of the moveable portion of the firearm when the at least one contact member is in the second position.

4. The apparatus of claim 1, wherein the actuator comprises a blocking member moveable between a first position in which the blocking member blocks movement of the at least one contact member and a second position in which the blocking member permits movement of the at least one contact member.

5. The apparatus of claim 1, wherein the firearm further comprises a trigger coupled to the at least one contact member, wherein movement of the trigger moves the at least one contact member between the first position and the second position.

6. The apparatus of claim 1, wherein the actuator comprises at least one elongate member moveable between a first position that causes movement of the at least one contact member toward the first position and a second position that causes movement of the at least one contact member toward the second position.

7. The apparatus of claim 1, wherein the apparatus comprises an additional elastic member, for biasing movement of the actuator when the at least one contact member is in the second position.

8. The apparatus of claim 1, wherein the recoil slide extends most of the length of the firearm.

9. The apparatus of claim 1, wherein the elastic member comprises a front end and a back end defining a length of the elastic member, wherein the recoil slide extends the length of the elastic member.

10. The apparatus of claim 1, wherein the recoil slide comprises a side wall positioned along the elastic member and the chamber slide, wherein the side wall comprises a notch adapted for receiving the at least one contact member in the first position.

11. The apparatus of claim 1, wherein the chamber slide comprises a notch adapted for receiving the at least one contact member in the second position.

12. A method for facilitating reloading of a firearm, wherein the firearm has a length extending between a front end of the firearm adjacent a barrel and a back end of the firearm, the method comprising the steps of:

providing ammunition into a firearm having an elastic member in communication with a moveable portion of the firearm, wherein the moveable portion comprises a recoil slide and a chamber slide, wherein the recoil slide extends about the elastic member and along the exterior of the chamber slide;

moving at least one contact member coupled to the moveable portion of the firearm, the elastic member, or combinations thereof, to a second position in which movement of the chamber slide is generally unaffected by the elastic member;

manually moving the chamber slide of the firearm to load ammunition into a chamber thereof, wherein manual movement of the chamber slide of the firearm is generally unaffected by the elastic member; and moving the at least one contact member to a first position in which movement of the chamber slide is biased by the elastic member such that a recoil force generated by discharging the firearm is resisted by the elastic member.

13. The method of claim 12, wherein the step of moving the at least one contact member to the second position comprises moving a grip slide of the firearm, coupled to the contact, in a first direction relative to the moveable portion to cause movement of the at least one contact member toward the second position, and wherein the step of moving the at least one contact member to the first position comprises moving the grip slide in a second direction to cause movement of the contact member toward the first position.

14. The method of claim 12, wherein the step of moving the at least one contact member to the second position, the step of moving the at least one contact member to the first position, or combinations thereof, comprise moving a blocking member from a first position, in which the blocking member blocks movement of the at least one contact member, to a second position, in which the blocking member permits movement of the at least one contact member.

15. The method of claim 12, wherein the step of moving the at least one contact member to the second position, the step of moving the at least one contact member to the first position, or combinations thereof comprises moving a trigger of the firearm, coupled to the at least one contact member, to cause movement of the at least one contact member.

16. The method of claim 13, wherein the chamber slide and the recoil slide additionally comprise at least one recess, and wherein the second position of the at least one contact member is located within the at least one recess of the chamber slide, and wherein the first position of the at least one contact member is located within the at least one recess of the recoil slide.

17. The method of claim 13, wherein the step of moving the grip slide in the first direction additionally comprises creating a biasing force in the second direction with an additional elastic member, and the step of moving the grip slide in the second direction comprises releasing it and allowing the biasing force of the additional elastic member to move the grip slide.

* * * * *